US006056684A

United States Patent [19]

Linder et al.

[11] Patent Number: 6,056,684

[45] Date of Patent: May 2, 2000

[54] LOCKING CENTRIFUGE ROTOR COVER ASSEMBLY

[75] Inventors: Benjamin Linder, Cambridge; Don Lee, Waltham, both of Mass.; Amy Battles, Boise, Id.; David M. Otten, Newton, Mass.

[73] Assignee: Massachusetts Institute of Technology, Cambridge, Mass.

[21] Appl. No.: 08/535,398

[22] Filed: Oct. 20, 1995

Related U.S. Application Data

[63] Continuation of application No. 08/259,928, Jun. 15, 1994, abandoned.

[51] Int. Cl.[7] ..... B04B 7/06

[52] U.S. Cl. ..... 494/12; 494/16; 494/60

[58] Field of Search ..... 436/45, 177; 494/10, 494/12, 16, 17, 20, 21, 38, 85, 60; 220/326; 535/398

[56] References Cited

U.S. PATENT DOCUMENTS

| | | | |
|---|---|---|---|
| 2,519,814 | 8/1950 | Bayless . | |
| 3,877,634 | 4/1975 | Rohde | 494/17 |
| 4,010,893 | 3/1977 | Smith et al. . | |
| 4,202,487 | 5/1980 | Edwards . | |
| 4,221,325 | 9/1980 | Fubota | 494/16 |
| 4,360,151 | 11/1982 | Cowell et al. . | |
| 4,412,830 | 11/1983 | Strain et al. . | |
| 4,435,169 | 3/1984 | Romanauskas | 494/20 |
| 4,449,965 | 5/1984 | Strain . | |
| 4,796,778 | 1/1989 | Habig | 220/326 |
| 4,850,951 | 7/1989 | Cheng et al. . | |
| 5,344,380 | 9/1994 | Chern | 494/16 |

FOREIGN PATENT DOCUMENTS

| | | |
|---|---|---|
| 0301183 | 2/1989 | European Pat. Off. . |
| 1295675 | 5/1962 | France . |
| 1295675 | 10/1962 | France . |
| 361540 | 4/1962 | Switzerland . |
| 8304379 | 12/1983 | WIPO . |

*Primary Examiner*—David Scherbel
*Assistant Examiner*—Terrence Till
*Attorney, Agent, or Firm*—Samuels, Gauthier, Stevens & Reppert

[57] ABSTRACT

A centrifuge rotor cover assembly for use with a centrifuge having a rotor and a housing enclosing the rotor and including a lid movable between a closed position overlying the rotor and an open position providing access to the rotor. The cover assembly includes a rotor cover removably coupled to the lid. Means are provided for engaging the rotor cover with the rotor for rotation therewith and for uncoupling the cover from the lid in response to the lid being moved to the closed position. Means are also provided for disengaging the rotor cover from the rotor and for coupling the cover to the lid in response to the lid being moved to the open position. In another embodiment of the present invention there is provided a locking centrifuge rotor cover that includes a locking mechanism having at least one locking element which engages a locking portion of the rotor so as to lock the cover onto the rotor, the locking element being responsive to centrifugally induced forces during rotation of the rotor for increasing the locking force between the cover and rotor. In a further embodiment of the present invention there is provided a centrifuge rotor cover locking hub which includes a hub housing having an upper portion and a lower portion, the upper portion being supported by the lid and the lower portion being adapted to releasably support the cover. A locking mechanism is disposed within the hub housing which locks the cover to the rotor in response to the cover being engaged with the rotor.

38 Claims, 4 Drawing Sheets

LOCKING CENTRIFUGE ROTOR COVER ASSEMBLY

This is a continuation of application Ser. No. 08/259,928 filed on Jun. 15, 1994 now abandoned.

BACKGROUND OF THE INVENTION

The present invention is directed to a locking centrifuge rotor cover assembly.

Conventional centrifuges typically include a housing with a centrifuge chamber, a rotor which supports the samples to be centrifuged, and a lid which is movable between an open position which accommodates access to the rotor and a closed position which encases the rotor and chamber. A rotor cover is often used to contain the contents of the centrifuge rotor during centrifugation. During normal operation, the containment of a liquid sample is secured when the sample is placed within a sealed sample tube, and thereafter covering the rotor with the rotor cover. However, the sample tube may be mishandled or have a defect which results in the rupture of the tube during high speed centrifugation, thus causing the sample liquid to become aerosolized and escape from the rotor if it is not properly sealed or covered. Accordingly, the rotor cover serves to enhance the containment of the samples. Also, in combination with the rotor, the cover forms a smooth surface that isolates the sample tubes from windage forces as well as reducing windage drag on the rotor.

In conventional centrifuges, the rotor cover has been designed as a separate unit from the centrifuge which requires manual attachment to the rotor for each use. Typically, the rotor cover includes a captive nut that is free to rotate, and which is screwed onto a threaded post at the center of the rotor to attach the cover to the rotor. Examples of this type of rotor cover design are found in U.S. Pat. Nos. 4,202,487, 4,360,151, 4,850,951, and 4,412,830, incorporated herein by reference.

The effectiveness of the use of a separate rotor cover, unfortunately, depends on the centrifuge operator remembering to attach the cover and completely tighten the nut. In the event of a human error where the cover is left off of the rotor, the samples could possibly be destroyed and the machine contaminated. In addition, the separate rotor cover takes up valuable laboratory counter space when it is removed from the machine, and can also be possibly misplaced.

It is therefore an object of the present invention to provide a centrifuge rotor cover which is retained within the centrifuge by coupling it to the lid or door of the centrifuge, thus obviating the need for separate manual attachment to the rotor.

It is another object of the present invention to provide a locking rotor cover wherein the cover is automatically attached to the rotor through the closing of the centrifuge lid or motion of the rotor, and thereafter allowing the cover to freely rotate with the rotor.

It is yet another object of the present invention to provide a rotor cover having a self-locking and un-locking centrifugal locking hub wherein the locking force increases with the rotational speed of the rotor.

SUMMARY OF THE INVENTION

Accordingly, one embodiment of the present invention provides a centrifuge rotor cover assembly for use with a centrifuge having a rotor and a housing enclosing the rotor and including a lid movable between a closed position overlying the rotor and an open position providing access to the rotor. The cover assembly includes a rotor cover removably coupled to the lid. Means are provided for engaging the rotor cover with the rotor for rotation therewith and for uncoupling the cover from the lid in response to the lid being moved to the closed position. Means are also provided for disengaging the rotor cover from the rotor and for coupling the cover to the lid in response to the lid being moved to the open position.

In another embodiment of the present invention there is provided an automatic locking centrifuge rotor cover for use with a centrifuge having a rotor disposed within a housing. The cover includes a locking mechanism having at least one locking element which engages a locking portion of the rotor so as to lock the cover onto the rotor, the locking element being responsive to centrifugally induced forces during rotation of the rotor for increasing the locking force between the cover and rotor.

In a further embodiment of the present invention there is provided a centrifuge rotor cover locking hub for a centrifuge having a rotor, a cover for the rotor and a centrifuge housing enclosing the rotor and including a lid movable between a closed position overlying the rotor and an open position providing access to the rotor. The locking hub includes a hub housing having an upper portion and a lower portion, the upper portion being supported by the lid and the lower portion being adapted to releasably support the cover. A locking mechanism is disposed within the hub housing which locks the cover to the rotor in response to the cover being engaged with the rotor.

DETAILED DESCRIPTION OF THE ILLUSTRATED EMBODIMENTS

Figure 1A:
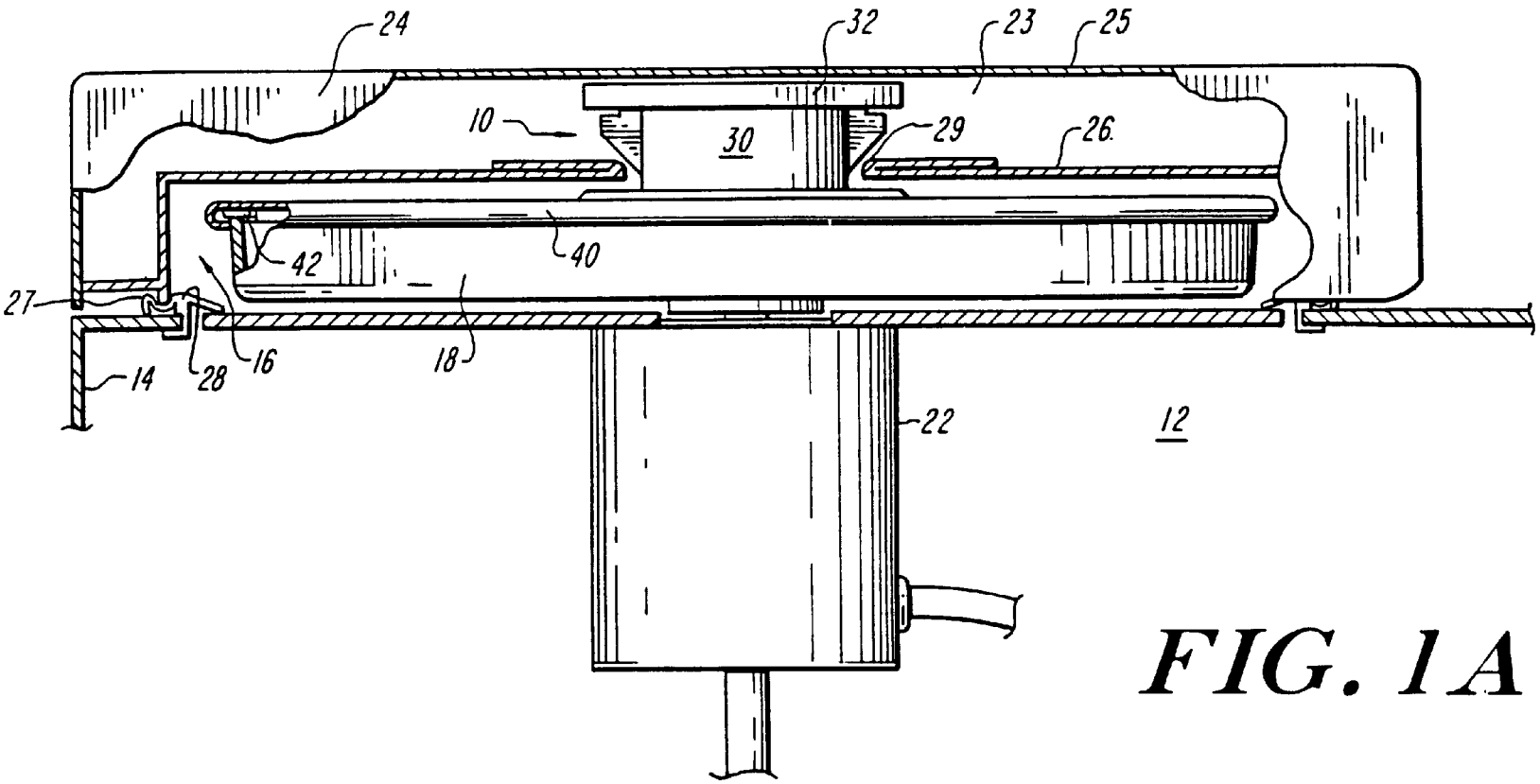
FIGS. 1A and 1B show partially cut-away side views of an exemplary centrifuge including a lid in a closed and opened position, respectively, utilizing the rotor cover assembly in accordance with the present invention.
Figure 1B:
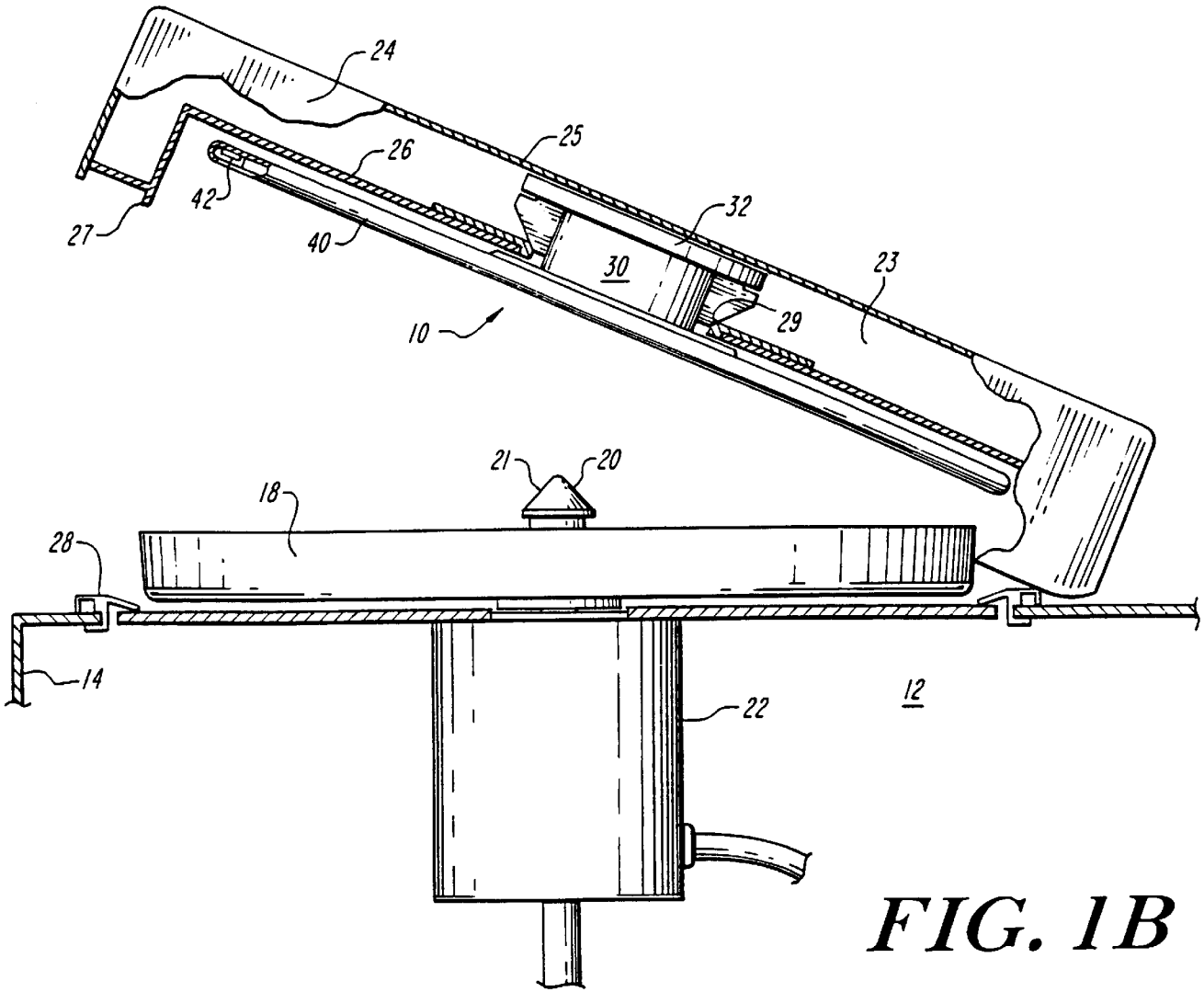

FIGS. 1A and 1B show the locking rotor cover assembly 10 as used in an exemplary centrifuge 12. The centrifuge 12 consists of a housing 14 including a lid 24 which is movable between a closed position and an open position as is respectively illustrated in FIGS. 1A and 1B. When the lid 24 is closed as shown in FIG. 1A, a centrifuge chamber 16 is defined which encases a centrifuge rotor 18 that receives the samples for centrifugation. The rotor includes a conical rotor nut 20 having conical head surface 21 which is connected to the shaft of a drive motor 22 for creating the rotation of the rotor 18.

The lid 24 is constructed with an upper wall 25 and a lower wall 26 with a cavity 23 defined therebetween. The lid also includes a lower perimeter edge 27 which when in the closed position interacts with a peripheral sealing gasket 28 associated with the housing 14, thus serving to create an airtight seal for the centrifuge chamber 16.

The rotor cover assembly 10 comprises a rotor cover 40 with an integrated locking hub 30. The top portion of the locking hub 30 is disposed within the cavity 23 between the upper wall 25 and the lower wall 26 of the lid, while a lower portion of the locking hub extends through the lower wall 26 and is coupled to the rotor cover 40 so as to retain the rotor cover within the underside of the lid 24 as will be hereinafter described.

As shown in FIG. 1A, when the lid 24 is closed, the rotor cover 40 is engaged with the rotor 18. A peripheral sealing gasket 42 is provided at the outer edge of the rotor cover for creating a seal with the outer peripheral edge of the rotor 18 which increases with the speed of rotation of the rotor. At the same time, the locking hub 30 is physically uncoupled from the lid so as to freely spin with the rotor and rotor cover during centrifugation. As shown in FIG. 1B, when the lid 24 is opened, the rotor cover is disengaged from the rotor 18, and the locking hub is physically coupled to the lid 24 in that the locking hub housing 32 contacts both the upper wall 25 and the cam surface 29 of the lower wall 26.

Figure 2:
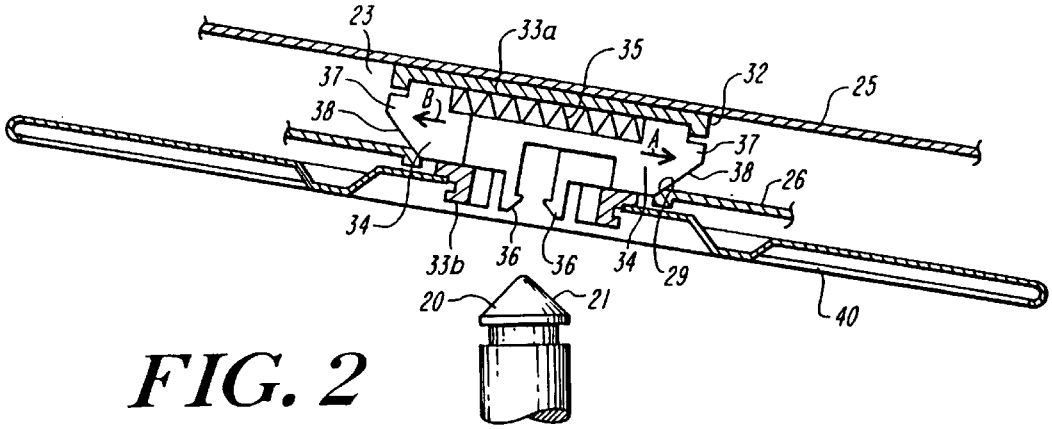
FIGS. 2–7 respectively show side sectional views of the rotor cover assembly during the process of opening and closing the centrifuge lid.

As is best shown in FIG. 2, the locking hub 30 includes a housing 32 having an upper portion 33*a* which is disposed in the cavity 23 defined between the upper wall 25 and the lower wall 26 of the lid 24. The housing 32 serves to support sliding latching pawls 34 which are normally biased against one another outwardly from the center of the hub with a spring 35 in the direction shown by the directional arrows A and B. The latching pawls 34 are configured with a lower extending latching hooks 36 which serve to latch onto the head of the rotor nut 20. It will be appreciated that the pawls can also be configured to latch onto either a lipped portion of the rotor or the motor shaft. Due to the bias of the spring 35, the hooks 36 are forced inwards towards the center of the hub. The latching pawls 34 also include an offsetting counterweight portion 37.

As is shown in FIG. 2, when the lid 24 is in the open position, the latching pawls 34 are outwardly biased so that an outward cam surface 38 of the counterweight portion 37 slides against a cam surface 29 defined in the opening in the lower wall 26. The interaction between the cam surfaces 38 and 29 force the upper portion 33*a* of the hub housing 32 upwards so as to contact the upper wall 25 of the lid. Accordingly, the locking hub 30 in this position is physically coupled within the lid 24. It will be appreciated that the lower portion 33*b* of the hub housing extends through the opening of the lower wall 26 and serves to supportably retain the cover 40 to the underside of the lid 24. Accordingly, the rotor cover 40 is held firmly against the underside of the lid when it is open. In a preferred embodiment, the rotor cover 40 is detachably coupled to the lower portion 33*b* with, for example, a snap ring so as to allow for cleaning of the rotor cover when necessary.

Figure 3:
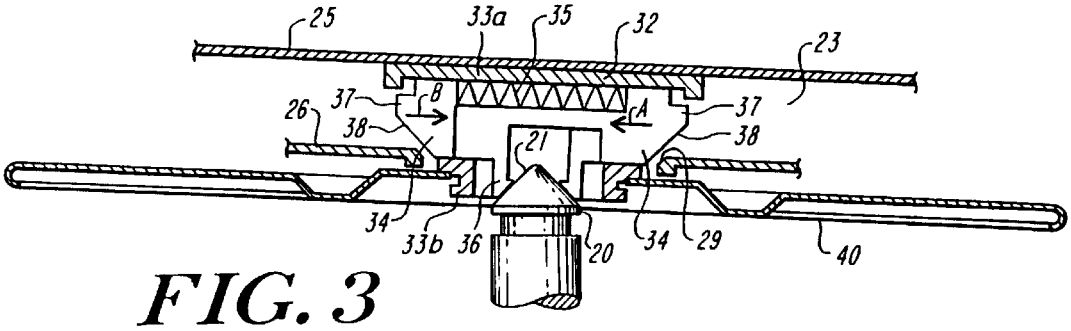
Figure 4:
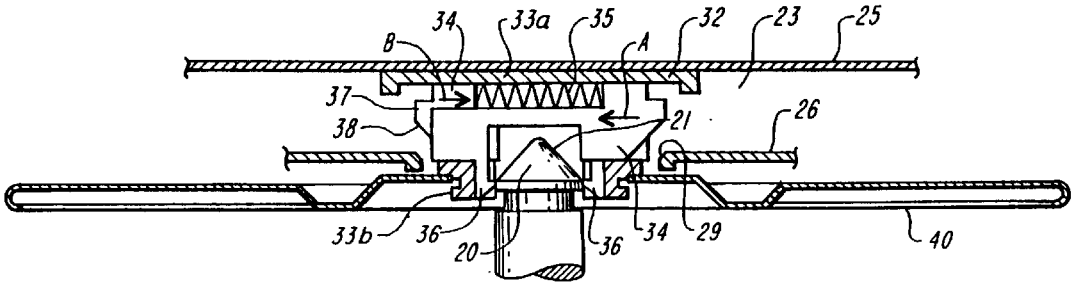

With reference to FIG. 3, as the lid 24 is moved towards the closed position, the latching hooks 36 come in contact with the conical surface 21 of the rotor nut 20. As the hooks slide down the conical surface, they are pushed apart from one another so as to cause the cam surfaces 38 and the offsetting counterweight portion 37 to move inwardly against the spring 35 as shown by the directional arrows A and B. Due to this action, the cam surfaces 38 are pushed in away from the cam surface 29 of the lower wall 26. As the lid 24 continues to close, the hooks 36 ride out and around the top of the rotor nut 20 along the surface 21 as shown in FIG. 4 so as to allow the hooks to open up enough for the rotor nut to fit therebetween. The hooks then snap over the rotor nut and latch onto the lip of the rotor nut 20 head. It will be appreciated by those of skill in the art that the previously described process for latching the hooks 36 onto the rotor nut 20 can be carried out with the use of an actuator driven system 19 wherein the rotor nut 20 is raised or lowered accordingly so as to move the rotor nut 20 in a latched position with respect to the hooks 36. The latching can also be carried out by raising or lowering the rotor cover without moving the lid.

Figure 5:
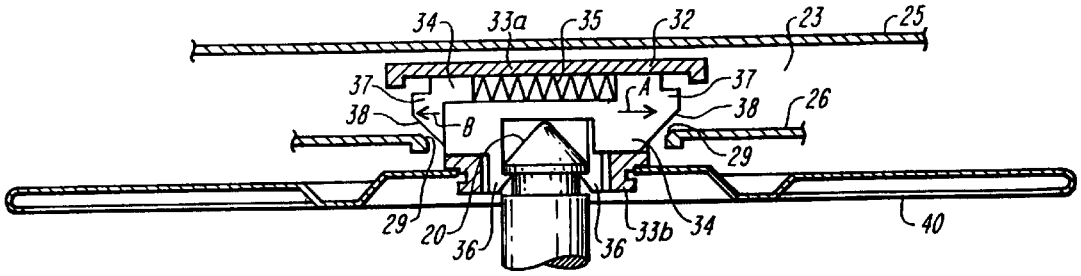

As shown in FIG. 5, the latching pawls 34 are again biased outwardly by the spring 35. However, due to the hooks 36 being spread apart by the rotor nut 20, the outer cam surfaces 38 do not contact the cam surface 29 of the lower wall 26. Furthermore, the upper portion 33*a* of the hub does not contact the upper wall 25. Accordingly, in this state, the locking hub 30 and the rotor cover 40 are physically uncoupled from the lid 24 so as to allow both to rotate with the rotor 18 during centrifugation.

As has been described with respect to FIG. 5, once the lid 24 is closed, the rotor cover 40 is engaged with the rotor 18 and the locking hub 30 is physically uncoupled from the lid 24. As the rotor cover is engaged with the rotor, the sealing gasket 42 is compressed against the rim of the rotor 18 so as to provide a small preload therebetween. This preload leads to a frictional force at the outer rim of the rotor 18 that transmits torque to the rotor cover so that both will spin in unison during centrifugation. In addition, this preload aids the sealing of the rotor cover during low speed rotation.

Once the rotor 18 and the rotor cover 40 begin to spin, the offsetting counterweight portions 37 of the latching pawls 34 produce a centrifugal radial force outward from both the rotor nut 20 and the axis of the rotation. This action in turn causes the hooks 36 to move inwardly towards the spinning axis, thus increasing the locking force between the locking hub 30 and the rotor nut 20. The greater the spin rate of the rotor cover 40, the greater the locking force effected by the hooks 36 of the latching pawls 34 on the rotor nut 20.

Figure 6:
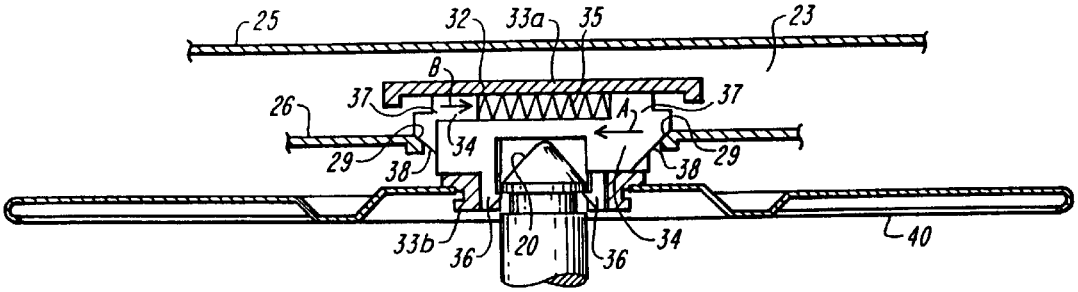

Once the spinning of the rotor 18 is complete, the rotor cover 40 is disengaged from the rotor 18 by opening the lid 24. With reference to FIG. 6, once the lid 24 begins to open, the cam surfaces 29 of the lower wall 26 contact the outer cam surfaces 38 of the latching pawls 34 and begin to push to latching pawls 34 inwardly as shown with the directional arrows A and B. As the separation force increases, the latching pawls 34 are pushed closer together causing the hooks 36 to move further apart and eventually are unlatched from the lip of the rotor nut 20 head.

Figure 7:
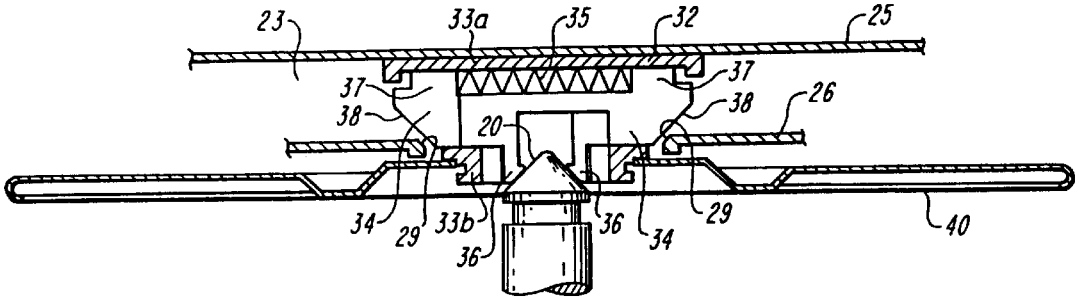

As the hooks 36 come free of the lip portion of the rotor nut 20, they begin to once again slide up the conical surface 21. At this point, the top portion of the housing 32 once again contacts the upper wall 25 as shown in FIG. 7. As the lid is continually opened, the outer cam surfaces 38 of the latching pawls 34 contact the cam surface 29 of the lower wall 26. At this point, the locking hub is again physically coupled to the lid 24, thus holding the rotor cover in place on the underside of the lid as shown in FIG. 2.

The foregoing description has been set forth to illustrate the invention and is not intended to be limiting. Since modifications of the described embodiments incorporating the spirit and substance of the invention may occur to persons skilled in the art, the scope of the invention should be limited solely with reference to the appended claims and equivalents thereof.

What is claimed is:

1. A centrifuge rotor cover assembly for use with a centrifuge having a rotor and a housing enclosing said rotor and including a lid movable between a closed position overlying said rotor and an open position providing access to said rotor, said cover assembly comprising:

a rotor cover removably coupled to said lid;

means for engaging said rotor cover with said rotor for rotation therewith and for uncoupling said cover from said lid in response to said lid being moved to said closed position;

means for disengaging said rotor cover from said rotor and for coupling said cover to said lid in response to said lid being moved to said open position; and a locking mechanism associated with said cover which comprises a hub that couples said rotor cover to the underside of said lid.

2. The assembly of claim 1, wherein said hub and rotor cover rotate freely with respect to said lid when said cover is engaged with said rotor.

3. The assembly of claim 1 further comprising a locking mechanism associated with said cover which locks said cover to said rotor in response to said cover being engaged with said rotor.

4. The assembly of claim 3, wherein said cover rotates freely with respect to said lid when engaged with said rotor.

5. The assembly of claim 3, wherein said locking mechanism is operable for unlocking said cover from said rotor in response to opening said lid.

6. The assembly of claim 3, wherein said latching element comprises a spring biased latching pawl.

7. The assembly of claim 6, wherein said locking mechanism is positioned at a center portion of said cover.

8. The assembly of claim 7, wherein said latching pawl engages a centrally located portion of said rotor.

9. The assembly of claim 3, wherein said locking mechanism comprises at least one latching element which engages a portion of said rotor so as to lock said cover on said rotor, said latching element being responsive to centrifugally induced forces during rotation of said rotor for increasing the locking force between said cover and rotor.

10. An automatic locking centrifuge rotor cover for use with a centrifuge having a rotor disposed within a housing, said cover comprising:

a locking mechanism having at least one locking element which engages a locking portion of said rotor so as to lock said cover onto said rotor, said locking element being responsive to centrifugally induced forces during rotation of said rotor for engaging said locking portion of said rotor, and means for increasing the locking force between said cover and rotor as said rotor is rotated.

11. The cover of claim 10, wherein said housing includes a lid, and wherein said rotor cover is removably coupled to the underside of said lid of said housing which is movable between a closed position overlying said rotor and an open position providing access to said rotor.

12. The cover of claim 11, wherein said cover is engaged with said rotor in response to said lid being moved to said closed position.

13. The cover of claim 12, wherein said locking element is disengaged from said locking portion in response to said lid being moved to said open position.

14. The cover of claim 11, wherein said locking mechanism comprises a hub which couples said rotor cover to the underside of said lid.

15. The cover of claim 14, wherein said hub and rotor cover rotate freely with respect to said lid when said cover is engaged with said rotor.

16. The cover of claim 10, wherein said locking element comprises a spring biased latching pawl.

17. The cover of claim 16, wherein said locking element is positioned at a center portion of said cover.

18. The cover of claim 16, wherein said centrifuge has a spin axis associated therewith, and wherein said latching pawl comprises a first end adapted for engagement with a portion of said rotor located on the spin axis of said centrifuge.

19. The cover of claim 18, wherein said latching pawl comprises a second end arranged to position the center of gravity on the opposite side of said spin axis with respect to the side on which said first end engages said portion of said rotor.

20. The cover of claim 19, wherein said second end is adapted to disengage said first end from said portion of said rotor in response to contacting a disengagement surface.

21. The cover of claim 20, wherein said disengagement surface is associated with said external lid.

22. The cover of claim 10, wherein said cover comprises an outer perimeter, and a seal associated with said outer perimeter which engages with the rim of said rotor to form a seal between said cover and rotor.

23. A centrifuge rotor cover locking hub for a centrifuge having a rotor, a cover for said rotor and a centrifuge housing enclosing said rotor and including a lid movable between a closed position overlying said rotor and an open position providing access to said rotor, said hub comprising:

a hub housing having an upper portion and a lower portion, said upper portion being supported by said lid and said lower portion being adapted to releasably support said cover;

a locking mechanism disposed within said hub housing which locks said cover to said rotor in response to said cover being engaged with said rotor.

24. The hub of claim 23, wherein said cover is engaged with said rotor in response to moving said lid to said closed position.

25. The hub of claim 23, wherein said locking mechanism is operable for unlocking said cover from said rotor in response to moving said lid to said open position.

26. The hub of claim 23, wherein said hub and rotor cover rotate freely with respect to said lid when said cover is engaged with said rotor.

27. The hub of claim 23, wherein said locking mechanism comprises at least one latching element which engages a latching portion of said rotor so as to lock said cover on said rotor, said latching element being responsive to centrifugally induced forces during rotation of said rotor for increasing the locking force between said cover and rotor.

28. The hub of claim 27, wherein said latching element comprises a spring biased latching pawl.

29. The hub of claim 28, wherein said centrifuge has a spin axis associated therewith, and wherein said latching pawl comprises a first end arranged for engagement with a portion of said rotor located on the spin axis of said centrifuge.

30. The hub of claim 29, wherein said latching pawl comprises a second end arranged to position the center of gravity on the opposite side of said spin axis with respect to the side on which said first end engages said portion of said rotor.

31. The hub of claim 30, wherein said first and second ends are axially displaced such that said first end is forced towards and said second end is forced away from said spin axis in response to said centrifugally induced forces.

32. The hub of claim 30, wherein said upper portion of said hub is retained in a cavity between upper and lower walls associated with said lid, said lower portion extending through said lower wall of said lid.

33. The hub of claim of claim 32, wherein said hub and rotor cover rotate freely with respect to said lid when said cover is engaged with said rotor.

34. The hub of claim 30, wherein said second end is adapted to disengage said first end from said portion of said rotor in response to contacting a disengagement surface associated with said lower wall of said lid.

35. The hub of claim 34, wherein said second end comprises a beveled surface which contacts said disengagement surface in response to opening said lid, said beveled surface otherwise avoiding contact when said cover is engaged with said rotor.

36. The hub of claim 35, wherein said first and second ends are axially displaced such that said first end is forced away from and said second end is forced towards said spin axis in response to said beveled surface contacting said lower wall of said lid.

37. The hub of claim 23, wherein said cover comprises an outer perimeter, and a seal associated with said outer perimeter which engages with the rim of said rotor to form a seal between said cover and rotor.

38. A centrifuge rotor cover assembly for use with a centrifuge having a rotor and a housing enclosing said rotor and including a lid movable between a closed position overlying said rotor and an open position providing access to said rotor, said cover assembly comprising:

a rotor cover removably coupled to said lid;

means for engaging said rotor cover with said rotor for rotation therewith and for uncoupling said cover from said lid in response to said lid being moved to said closed position;

means for disengaging said rotor cover from said rotor and for coupling said cover to said lid in response to said lid being moved to said open position; and a locking mechanism associated with said cover which locks said cover to said rotor in response to said cover being engaged with said rotor, said locking mechanism including at least one latching element which engages a portion of said rotor so as to lock said cover on said rotor, said latching element being responsive to centrifugally induced forces during rotation of said rotor for increasing the locking force between said cover and rotor.

* * * * *